US005674097A

United States Patent [19]

McCleerey

[11] Patent Number: 5,674,097

[45] Date of Patent: Oct. 7, 1997

[54] ELECTRICAL CONNECTOR WITH WEDGE

[75] Inventor: Earl William McCleerey, Mechanicsburg, Pa.

[73] Assignee: The Whitaker Corporation, Wilmington, Del.

[21] Appl. No.: 529,116

[22] Filed: Sep. 15, 1995

[51] Int. Cl.[6] ..... H01R 4/50

[52] U.S. Cl. ..... 439/863

[58] Field of Search ..... 439/783, 863

[56] References Cited

U.S. PATENT DOCUMENTS

| | | | |
|---|---|---|---|
| 2,106,724 | 2/1938 | Cope | 173/273 |
| 3,065,449 | 11/1962 | Matthysse et al. | 339/247 |
| 3,065,452 | 11/1962 | Osborn | 339/274 |
| 3,280,856 | 10/1966 | Broske et al. | 140/113 |
| 3,290,746 | 12/1966 | Broske | 24/126 |
| 3,329,928 | 7/1967 | Broske | 339/247 |
| 3,349,167 | 10/1967 | Mixon, Jr. et al. | 439/783 |
| 3,462,543 | 8/1969 | Wahl et al. | 174/94 |
| 3,588,791 | 6/1971 | Polidori | 439/783 |
| 4,027,939 | 6/1977 | White | 439/783 |
| 4,059,333 | 11/1977 | Mixon, Jr. | 339/247 |
| 4,162,819 | 7/1979 | Eisert | 339/247 |
| 4,215,911 | 8/1980 | Dittmann et al. | 339/240 |
| 4,478,479 | 10/1984 | Cherry et al. | 339/273 R |
| 4,650,273 | 3/1987 | Roosdrop | 439/863 |
| 4,720,275 | 1/1988 | Swart et al. | 439/725 |
| 4,795,365 | 1/1989 | Johnston et al. | 439/863 |
| 4,840,580 | 6/1989 | Saell et al. | 439/431 |
| 5,006,081 | 4/1991 | Counsel et al. | 439/783 |
| 5,044,996 | 9/1991 | Goto | 439/783 |
| 5,151,560 | 9/1992 | Kreinberg et al. | 174/94 R |
| 5,281,173 | 1/1994 | Cherry et al. | 439/783 |
| 5,321,577 | 6/1994 | Capper et al. | 361/119 |
| 5,340,335 | 8/1994 | Haun | 439/783 |
| 5,423,699 | 6/1995 | Johnson | 439/783 |

FOREIGN PATENT DOCUMENTS

| | | | |
|---|---|---|---|
| 18800 | 11/1980 | European Pat. Off. | 439/863 |

*Primary Examiner*—Gary F. Paumen
*Attorney, Agent, or Firm*—Anton P. Ness

[57] ABSTRACT

An electrical connector comprising: a conducting wedge (2), an inclined surface (14) on one side of the wedge (2), a conductive wedge receiving body (3), an opening (4) extending into the body (2), a wire engaging floor (5) on one side of the opening (4), a pair of arms (6) on opposite sides of the opening (4), and the wedge (2) being received in the opening (4) to clamp onto at least one wire (12).

21 Claims, 11 Drawing Sheets

ELECTRICAL CONNECTOR WITH WEDGE

FIELD OF THE INVENTION

The invention relates to an electrical connector for establishing an electrical connection with an electrical wire, and, more particularly, to an electrical connector in which a wedge is driven compressively against an electrical wire to establish an electrical connection with the wire.

BACKGROUND OF THE INVENTION

U.S. Pat. No. 5,281,173 discloses an electrical connector comprising, a wedge receiving body having wire receiving channels alongside a wedge receiving area, and a conducting wedge that is received along the wedge receiving area, the wedge being driven compressively against electrical wires that have been placed along the channels to establish an electrical connection by clamping the wires between the wedge and the wedge receiving body. This connector, as disclosed by the prior patent, interposes an electrical wire between the wedge and the wedge receiving body. Shrinkage of the wire due to creep and thermal contraction would reduce the clamping force on the wire. The body must be resilient for expansion and contraction, to compensate for such shrinkage of the wire. A direct contact between the wedge and the wedge receiving body is desired to provide a rigid clamp. A rigid clamp can apply a high clamping force against the wire, a force not limited by resiliency of the clamp.

U.S. Pat. No. 4,720,275 discloses an electrical connector comprising a ramp on a first tube, and a second tube encircling the ramp and clamping an electrical wire against the ramp to establish an electrical connection between the wire and the ramp on the first tube. The wire must be inserted into the first tube prior to the second tube being moved into a position of encircling the first tube. The disadvantage of this connector resides in a need for the wire to be inserted internally of both the tube having the wedge and the wedge receiving tube.

SUMMARY OF THE INVENTION

The present invention comprises an electrical connector in which a wedge is driven compressively against an electrical wire to establish a clamping force on the wire, and the wedge directly engages a wedge engaging body into which the wedge and the wire is inserted.

An advantage of the invention resides in a clamping connection of a wedge on an electrical wire that does not require resiliency in a wedge receiving body into which the wedge and the wire are inserted.

DESCRIPTION OF THE DRAWINGS

Embodiment of the invention will now be described by way of example with reference to the accompanying drawings, according to which.

DETAILED DESCRIPTION

Figure 1:
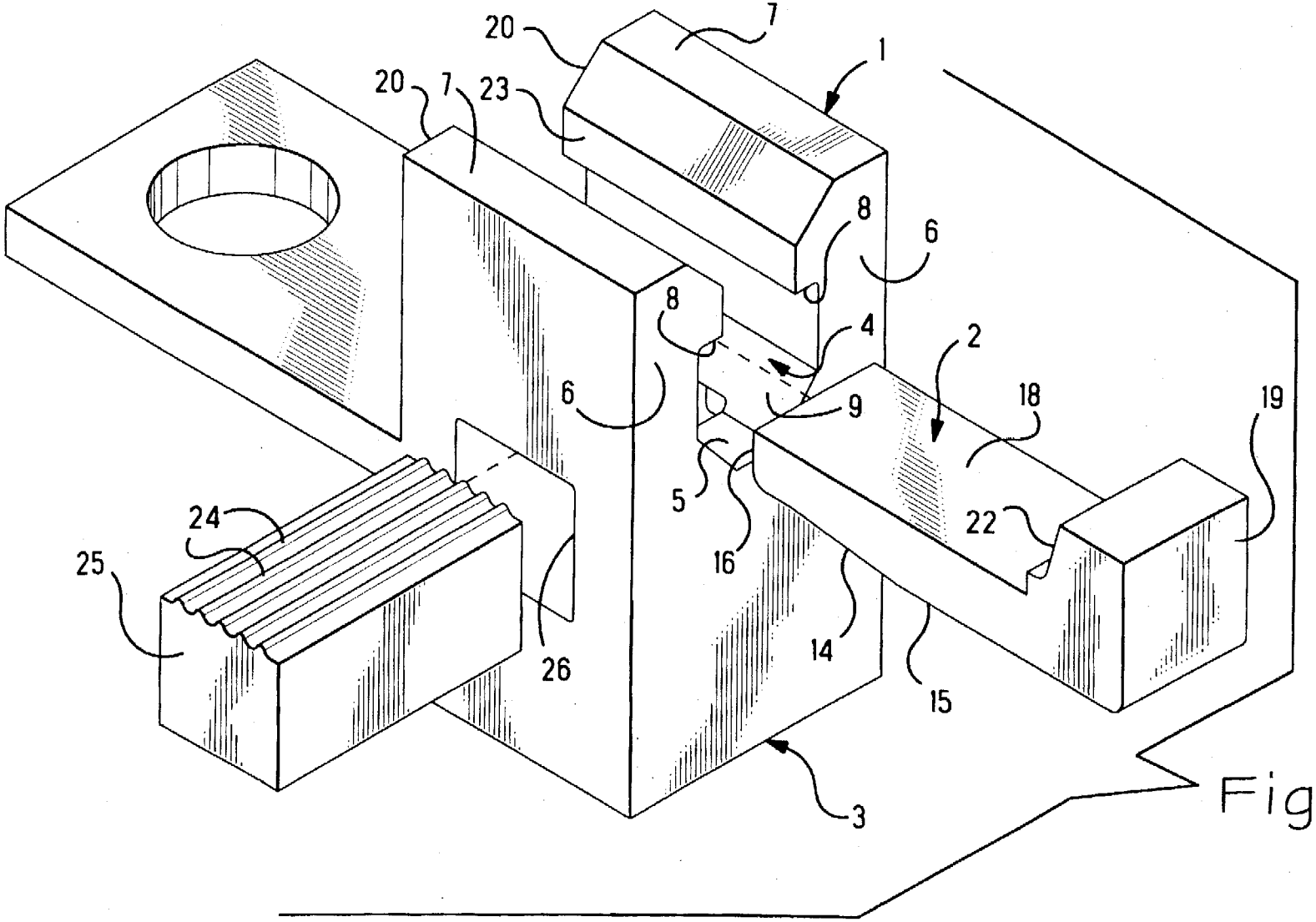
FIG. 1 is an isometric view of an electrical connector comprising a wedge and a wedge engaging body.
Figure 2:
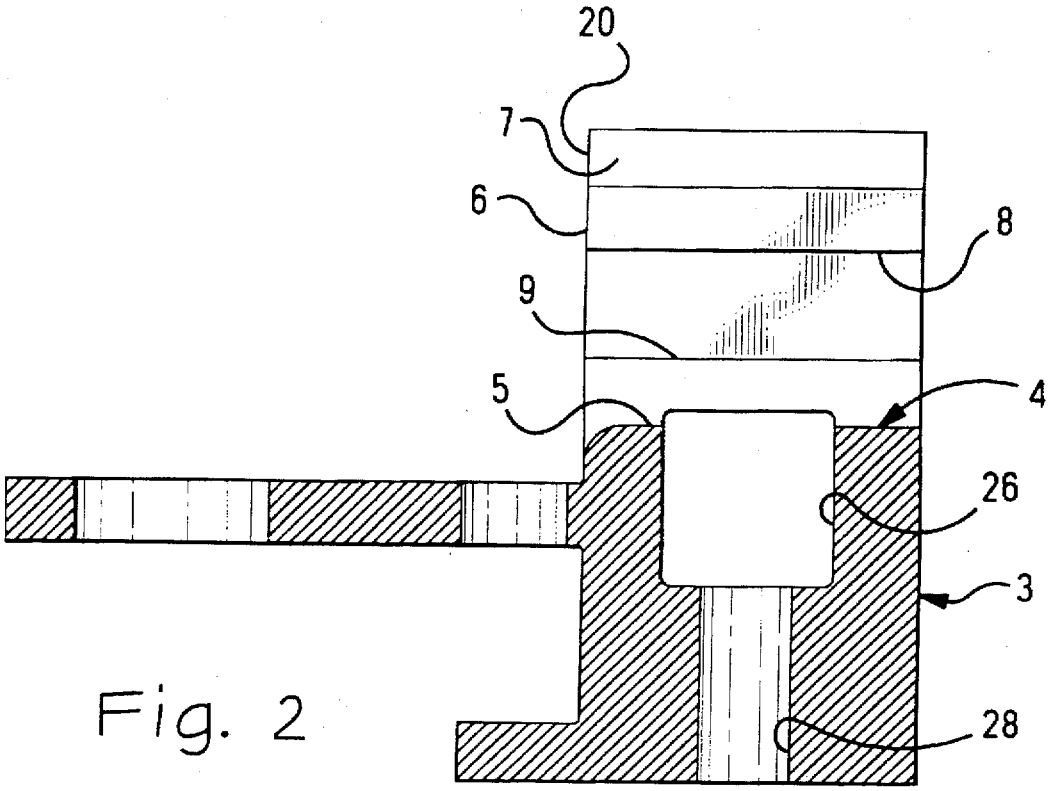
FIG. 2 is a side view of the wedge engaging body as shown in FIG. 1 with parts cut away.
Figure 3:
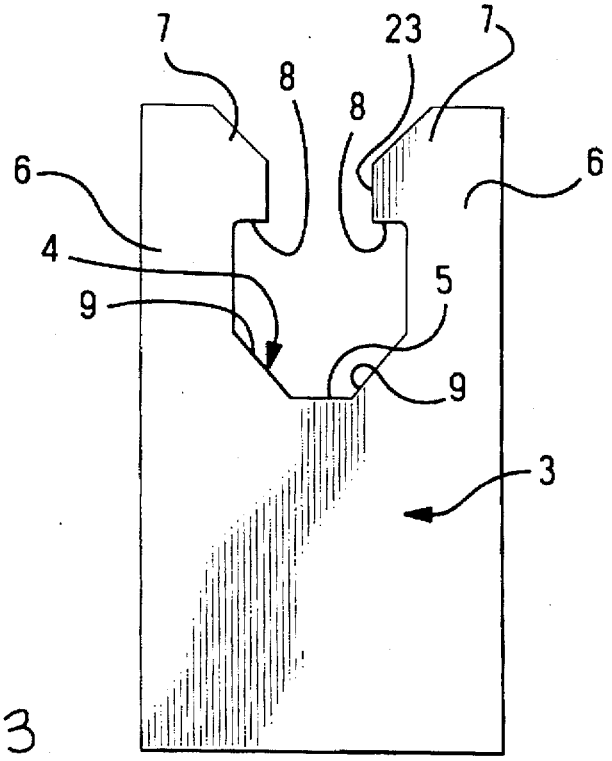
FIG. 3 is an end view of the wedge engaging body.

With reference to FIGS. 1–4, 5–10 and 15, 18 and 22–24, embodiments of an electrical connector 1 will now be described, with similar parts of the embodiments being referred to with the same reference numerals. The connector 1 comprises an electrically conducting wedge 2, and a conducting, wedge receiving body 3. The wedge 2 and the body 3, as shown in FIGS. 1–4 are machined metal parts. As shown in FIGS. 5–10, the wedge 2 is a unitary machined metal part. The body 3 is a unitary blank of metal that has been stamped, to a desired shape, and formed, by bending.

What reference to each embodiment, features of the body 3 will now be described. A wedge receiving opening 4 extends into the body 3. A wire engaging floor 5 is on one side of the opening 4. A pair of arms 6 projects from the floor 5 and extend on opposite sides of the opening 4. Free ends 7 of the arms 6 extend toward each other to partially encircle the wedge receiving opening 4. An inverted, wedge engaging side 8 of the opening 4 is on each of the arms 6. Each wedge engaging side 8 faces toward the floor 5.

A ledge 9 within the opening 4 extends along interior sides 10 on each of the arms 6. The ledge 9 slidably supports the wedge 2 in spaced relationship with respect to the floor 5. A wire receiving space 11, FIGS. 4, 5, 6 and 17, for example, is defined between the floor 5 and the wedge 3. The ledge 9 keeps the wedge 2 away from the floor 5, but allows movement of the wedge 2 away from the floor 5 so as to increase the width of the wire receiving space 11.

With respect to the embodiment as shown in FIGS. 5–10, the ledge 9 comprises, a series of tabs within the opening 4 slidably supporting the wedge 2 in spaced relationship from the floor 5, the tabs being struck out of the thickness of respective, both arms 6 to project inwardly of the opening 4. With respect to each embodiment as shown in FIGS. 1–4 and FIGS. 15–18 and 22–24, the ledge 9 comprises, a shoulder along each of the arms 6 within the opening 4 slidably supporting the wedge 2 in spaced relationship from the floor 5.

Figure 5:
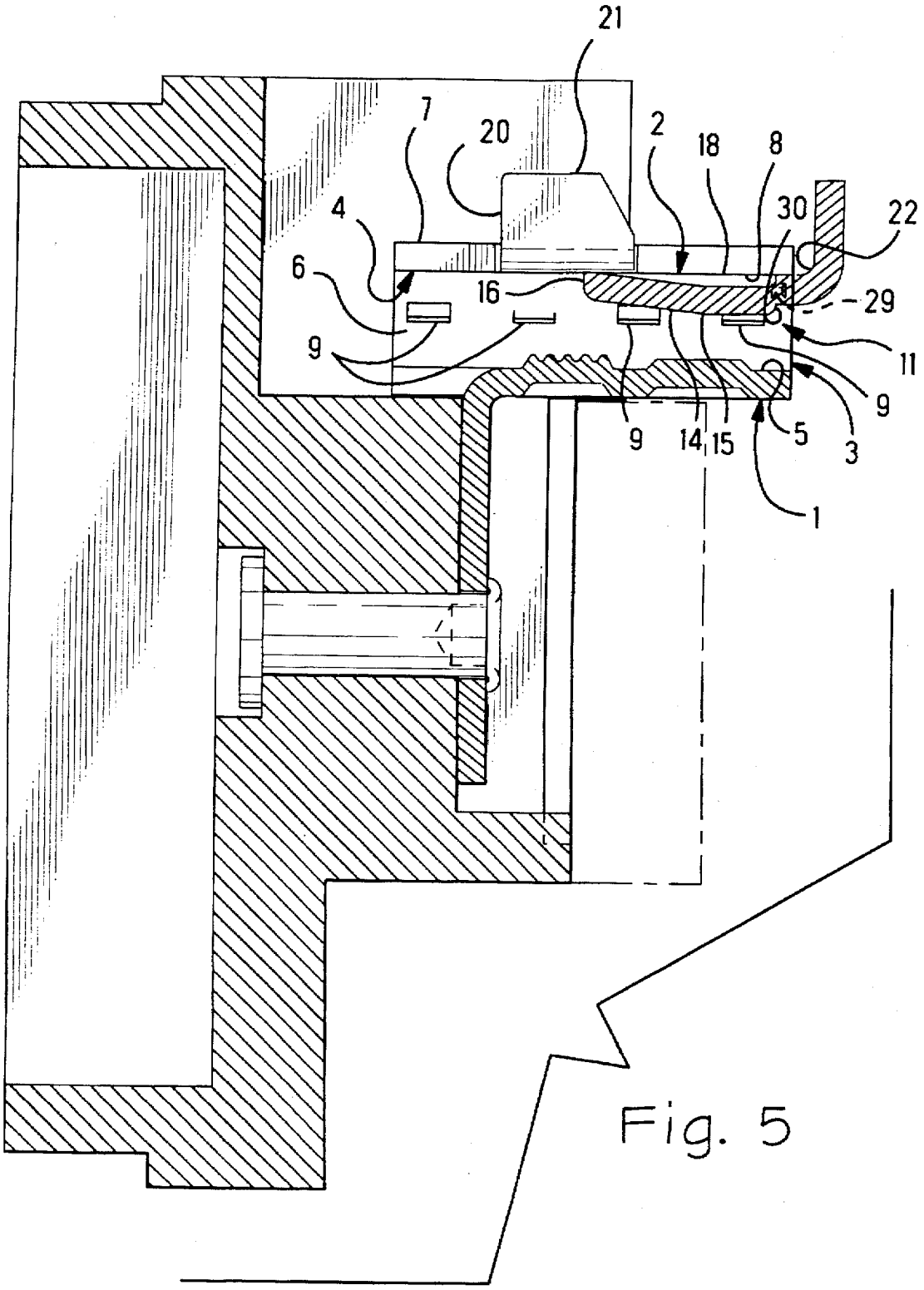
FIG. 5 is a side view of another electrical connector comprising a wedge and a wedge engaging body, together with a terminal block, and with parts cut away.

As shown, for example, in FIG. 5, the wedge 2 has been inserted into the opening 4, and is at an initial position, partially retracted from the opening 4. A corresponding end of at least one conducting, electrical wire 12, projecting from insulation 13 on the wire 12, is poked into and along the wire receiving space 11 of the wedge receiving opening 4. The wedge 2 is moved further into the opening 5, according to the following procedure. The wedge 2 is slidable along each wedge engaging side 8 of the opening 4. The wedge 2 becomes compressed against each wedge engaging side 8. The wedge 2 compresses the at least one electrical wire 12 against the wire engaging floor 5 of the opening 4, as shown, for example, in FIG. 6, to clamp the wire 12 between the wedge 2 and the floor 5. Accordingly, an electrical connection with the wire 12 is attained. The electrical connection is attained with greater speed and with more consistent clamping force than was previously attained by wrapping a wire around a common screw fastener, followed by tightening the screw fastener. The connection with the wire 12 can be disconnected by partially retracting the wedge 2 from the opening 5, which releases the wire 12.

In each embodiment, the wedge 2 is shaped with the following features; at least one wire engaging, inclined surface 14 on one exterior side of the wedge 2, and a noninclined wire engaging surface 15, parallel with the floor 5, and parallel with the axis of the wire 12, intersecting the inclined surface 14. Both of the wire engaging surfaces 14, 15 on the same wedge 2 face toward the floor 5. The wire receiving space 11, between the floor 5 and both of the wire engaging surfaces 14, 15, is narrower in width than a thickness of the same wire 12 to be compressively engaged by both wire engaging surfaces 14, 15.

Figure 12:
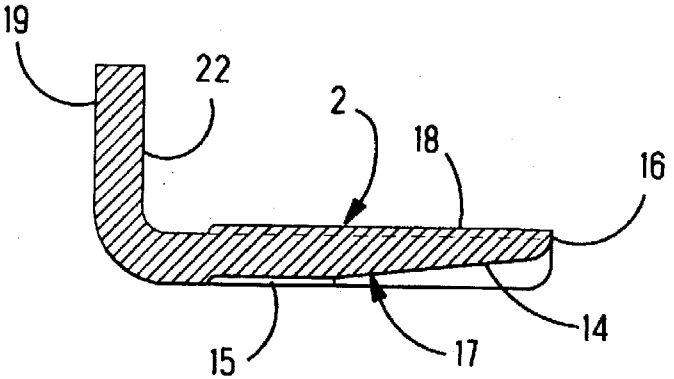
FIG. 12 is a section view taken along a line 12—12 in FIG. 13.
Figure 17:
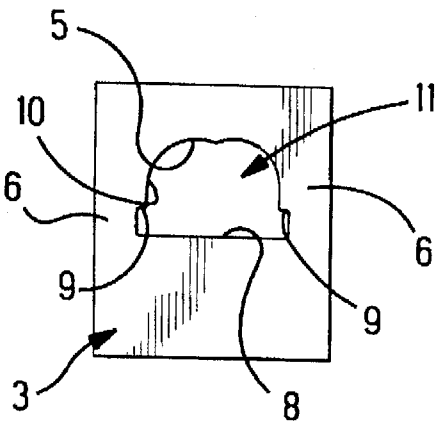
FIG. 17 is an end view of the body shown in FIG. 16.
Figure 16:
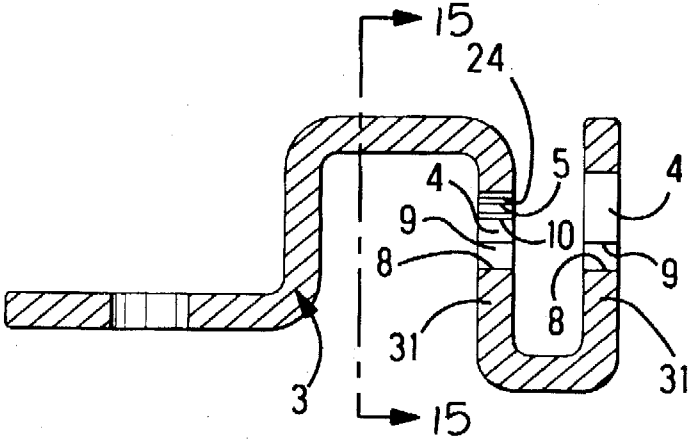
FIG. 16 is a side view in section taken along line 16—16 of FIG. 18 of the body shown in FIG. 15.
Figure 18:
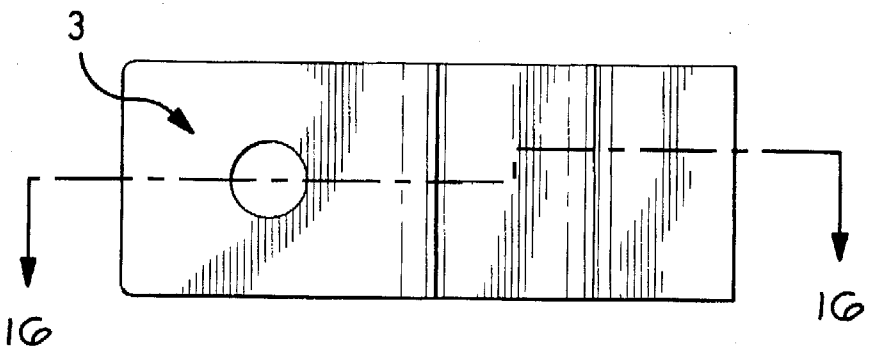
FIG. 18 is a top view of the body shown in FIG. 16.
Figure 15:
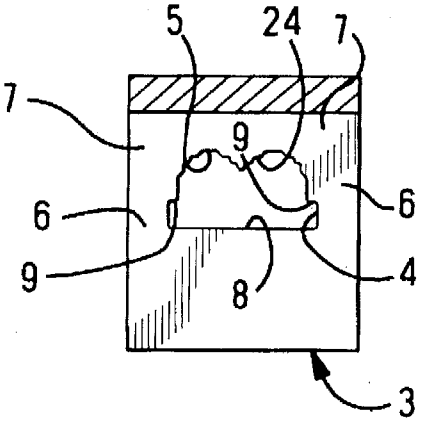
FIG. 15 is a section view taken along line 15—15 of FIG. 16 of another wedge engaging body.
Figure 19:
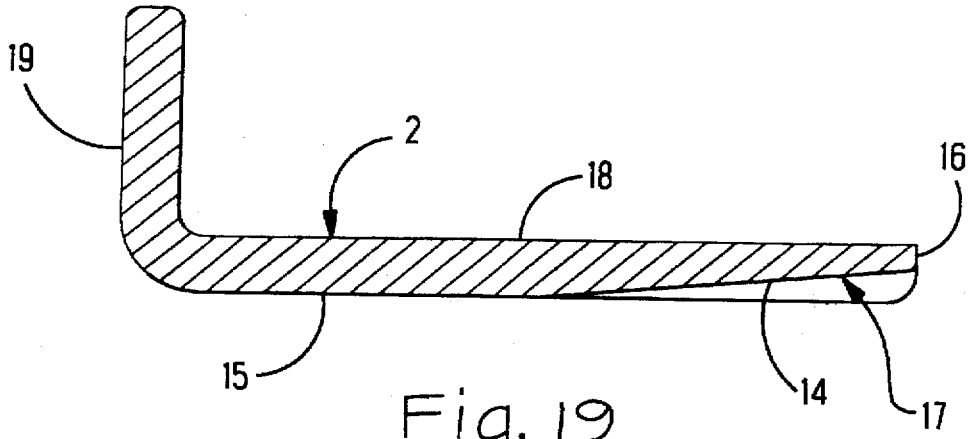
FIG. 19 is a side view in section of another wedge.
Figure 20:
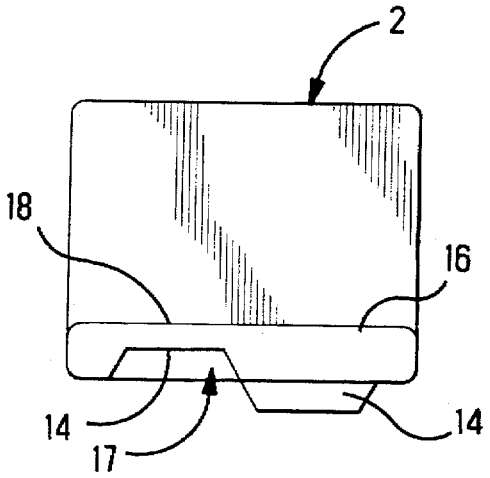
FIG. 20 is an end view of the wedge shown in FIG. 19.
Figure 21:
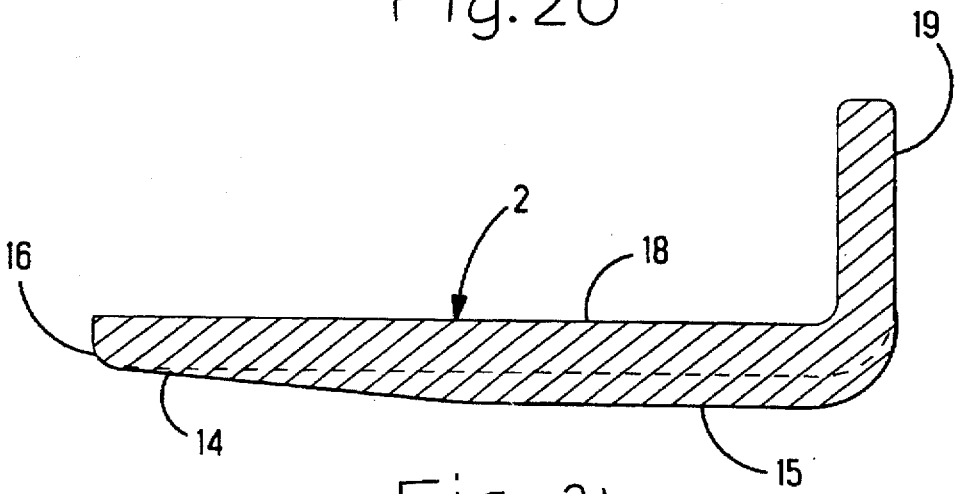
FIG. 21 is a side view in section of the wedge shown in FIG. 20.
Figure 23:
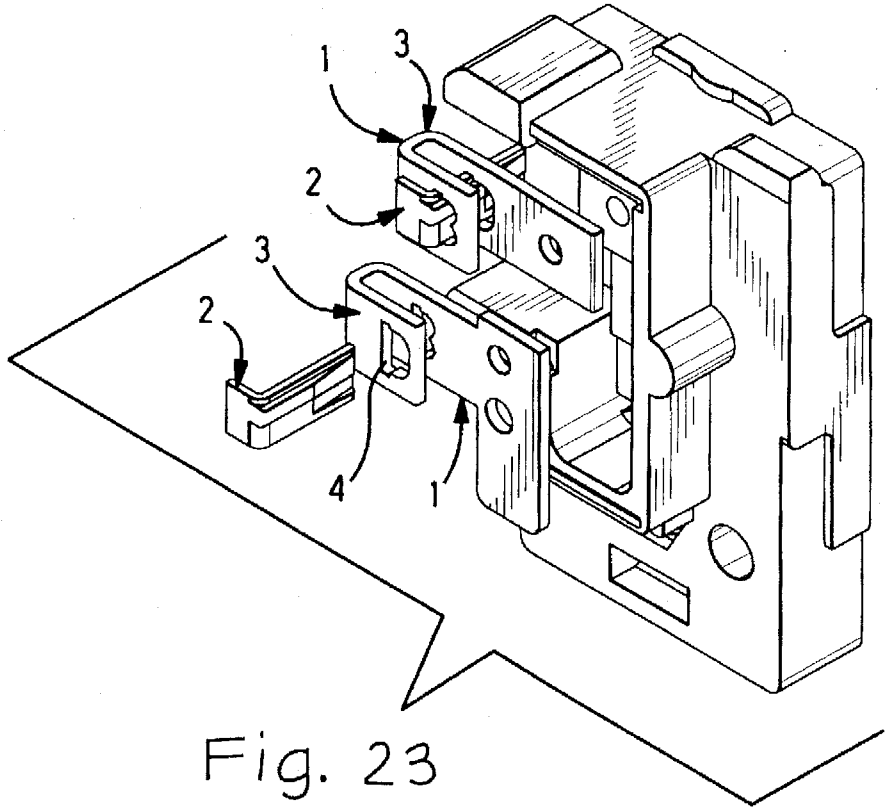
FIG. 23 is a view similar to FIG. 24 of another electrical connector, together with another terminal block.
Figure 22:
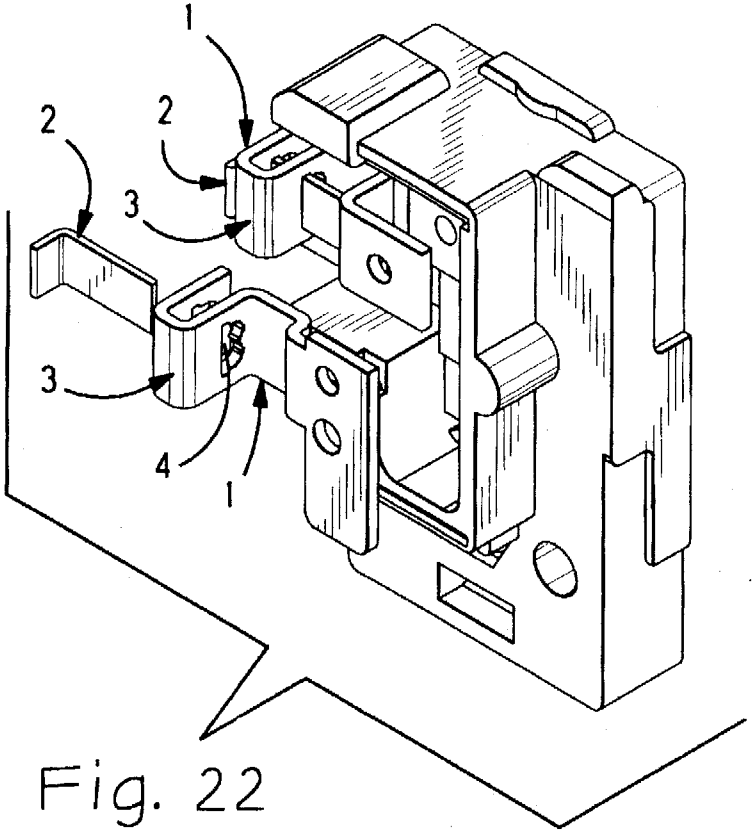
FIG. 22 is an isometric view of another electrical connector comprising a wedge and a wedge receiving body, together with a terminal block, and with parts separated from one another.
Figure 24:
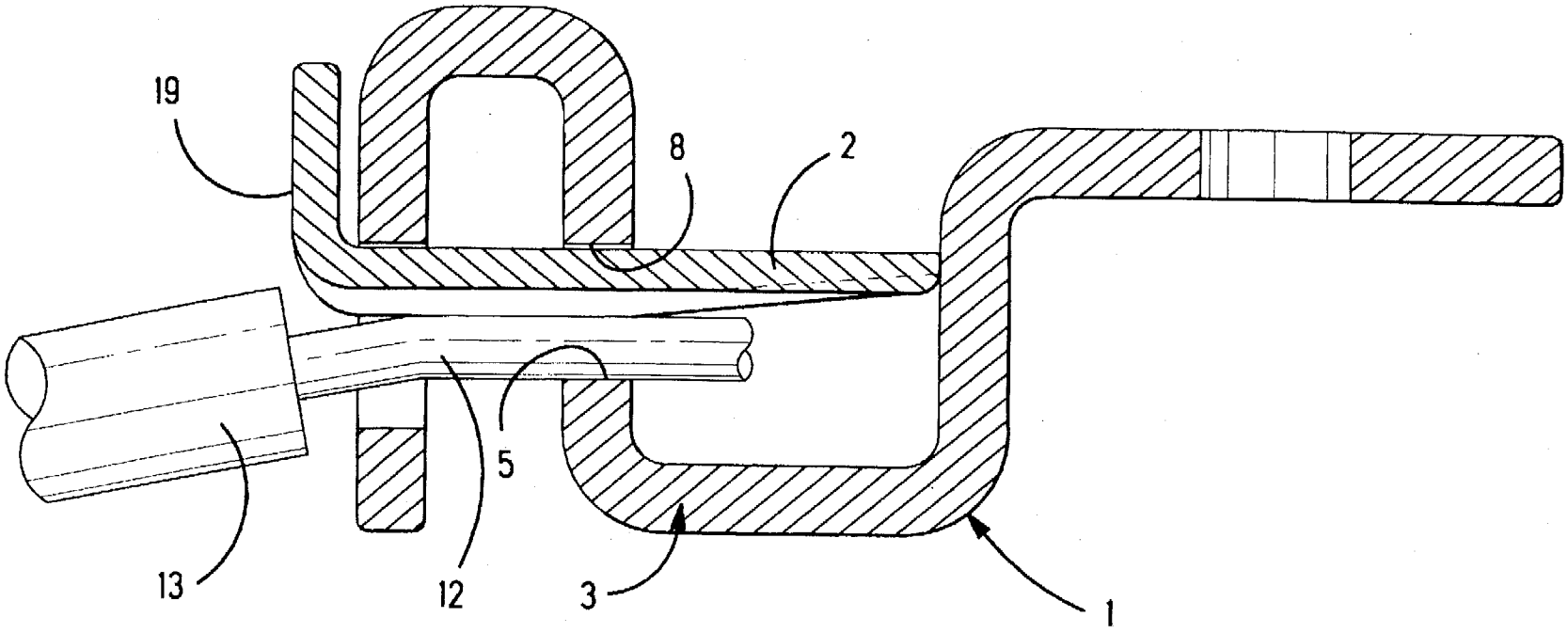
FIG. 24 is a view similar to FIG. 16, illustrating a wire connected to the connector shown in FIG. 22 or FIG. 23.

In FIGS. 1–4, the inclined surface 14 extends from a forward end 16 of the wedge 2. As shown in FIGS. 5–10, and in FIGS. 15–24, the inclined surface 14 is divided to provide two inclined surfaces 14, side by side, extending from the forward end 16 of the wedge 2. The two inclined surfaces 14 have different rates of incline, or different slopes. With reference to FIG. 12 and FIG. 19, one of the two inclined surfaces 14 extends along a channel 17 recessed in the one side of the wedge 2. The other of the inclined surfaces 14 projects outwardly from a remainder of the one side of the wedge 2. With respect to each embodiment, each corresponding inclined surface 14 faces toward the wire engaging floor 5, and compresses and clamps against a corresponding electrical wire 12, for example the wire 12 shown in FIG. 6 and FIG. 24. In FIGS. 5–10 and in FIGS. 15–24, the two inclined surfaces 14 are at different distances from the floor 5 to compress and clamp against respective wires 12 having different thicknesses. For example, a wire 12 of Number Ten American Wire Gauge has an area in cross section of 0.008 square inches (0.020 square centimeters). Further, for example, a smaller wire 12 of Number Twelve American Wire Gauge has a smaller area in cross section. The smaller wire 12 is adequately compressed and clamped by the surface 14 that is closer to the floor 5. That same surface 14 might exert excessive compression on a larger wire 12, causing the larger wire 12 to deform and weaken its ability to withstand tension. Accordingly, the surface 14 that is farther from the floor 5 is desired to clamp the larger wire 12.

Each embodiment of the wedge 2 further comprises, a sliding surface 18 on another side on the wedge 2 opposite the one side on which the corresponding inclined surface 14 is provided. The sliding surface 18 is slidable along each of the wedge engaging surfaces 8 on the body 3.

Figure 6:
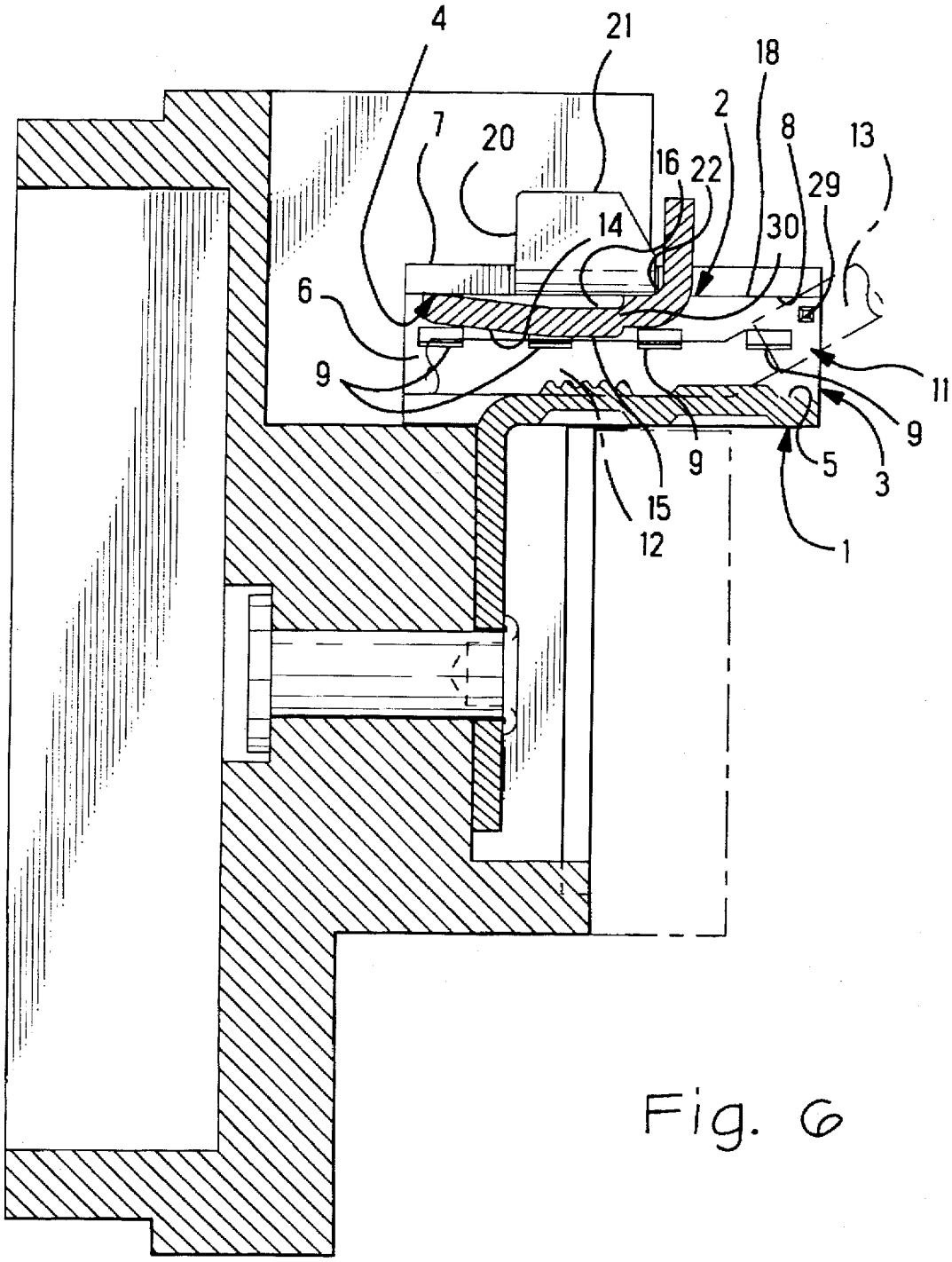
FIG. 6 is a view similar to FIG. 5 illustrating an electrical connection of the connector with an electrical wire.
Figure 7:
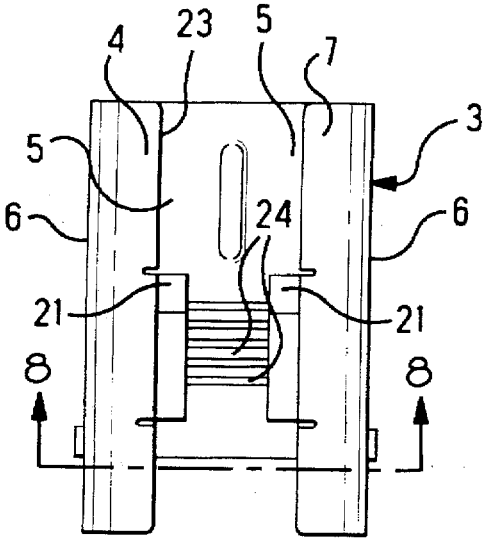
FIG. 7 is a top view of the connector shown in FIG. 5 without the terminal block.
Figure 8:
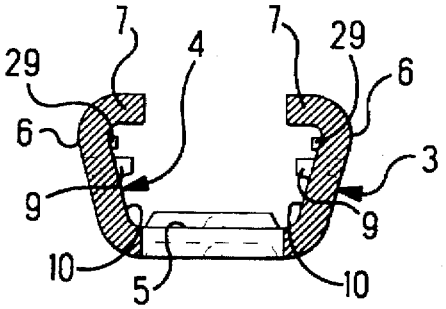
FIG. 8 is a section view taken along a line 8—8 of FIG. 7.
Figure 9:
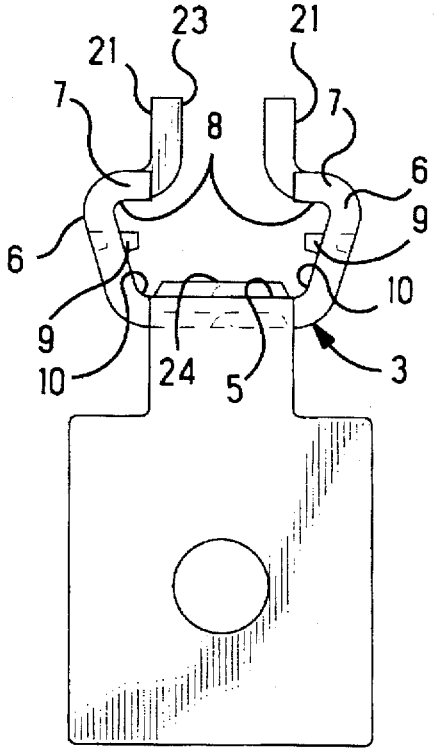
FIG. 9 is an end view of the connector shown in FIG. 7.
Figure 10:
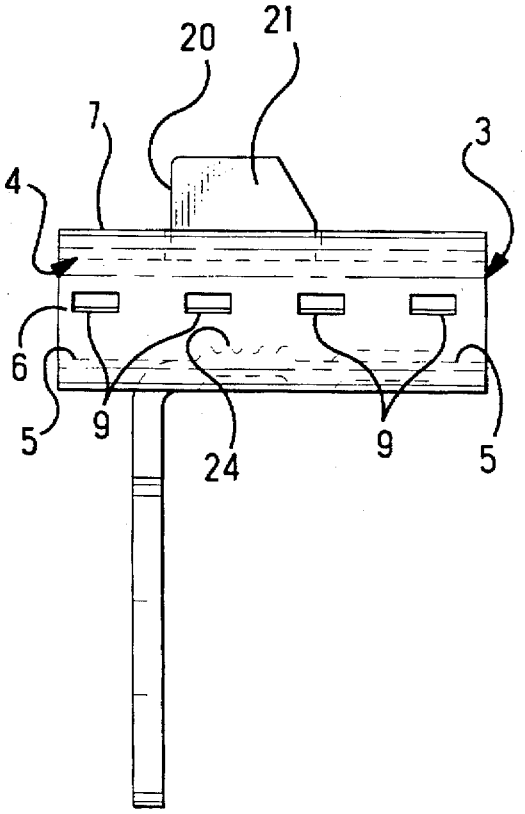
FIG. 10 is a side view of the connector shown in FIGS. 7 and 8.
Figure 11:
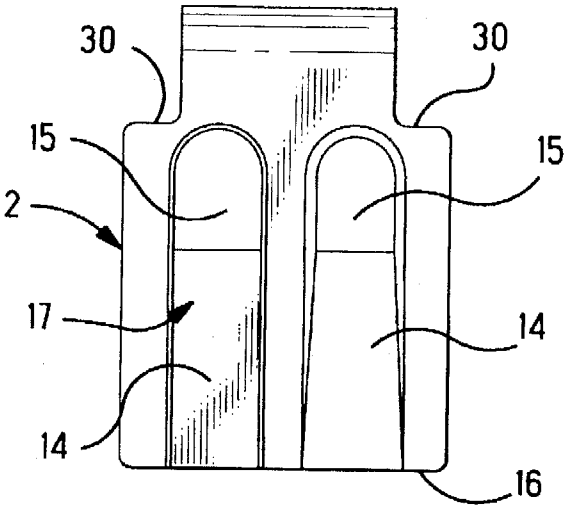
FIG. 11 is a bottom view of a wedge of the connector shown in FIG. 7.
Figure 14:
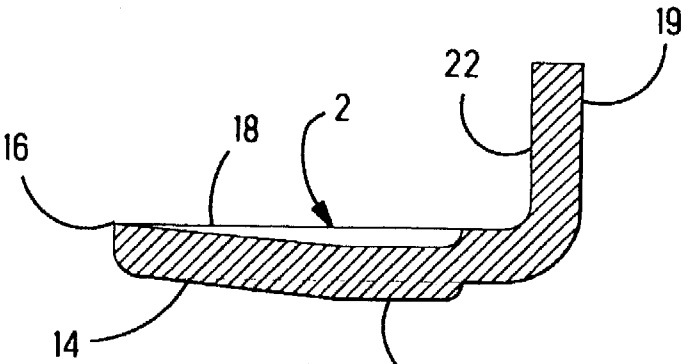
FIG. 14 is a section view taken along a line 14—14 of FIG. 13.
Figure 13:
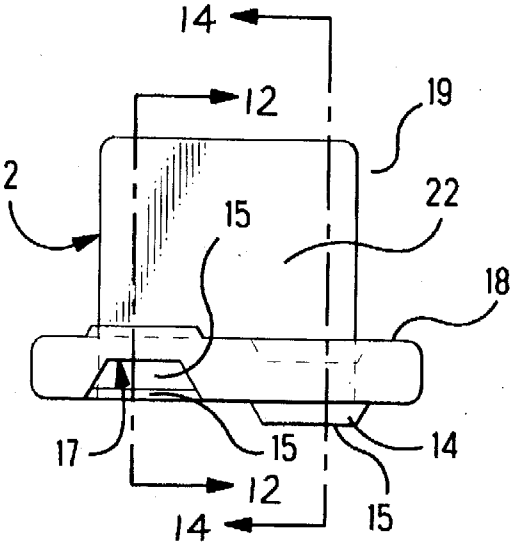
FIG. 13 is an end view of the wedge shown in FIG.

Each wedge 2 further comprises, a tool engaging portion 19. For example, the tool engaging portion 19 comprises, upturned end on the wedge 2 projecting above the sliding surface 18 on the wedge 2. For example, jaws on a common pair of pliers, not shown, can straddle the tool engaging portion 19 and the body 2. When the jaws close toward each other, the wedge 2 will be driven into the opening 4 to establish an electrical connection with the wire 12. Another tool engaging portion 20 is on an exterior of the arms 6. As shown in FIGS. 5 and 6, the tool engaging portion 20 on each of the arms 6 can be raised by projections 21 that project upwardly from each of the arms 6 on the body 3 to be engaged by the jaws of the pliers. Against the tool engaging portion 19 is a stop surface 22 facing the body 3. The stop surface 21 is impelled toward the body 3 during movement of the wedge 2 farther into the opening 4 in the body 3. The stop surface 21 engages the body 3 to limit further movement of the wedge 2 farther into the opening 4.

Each embodiment of the body 3 in FIGS. 1–4, and in FIGS. 5–14, further comprises, a slot 23 with open ends extending between the arms 6 at the free ends 7, a width of the slot 23 being smaller than a width of the wedge 2. The slot 23 provides a space between the arms 6 to accommodate cantilever deflection of the arms 6.

Figure 4:
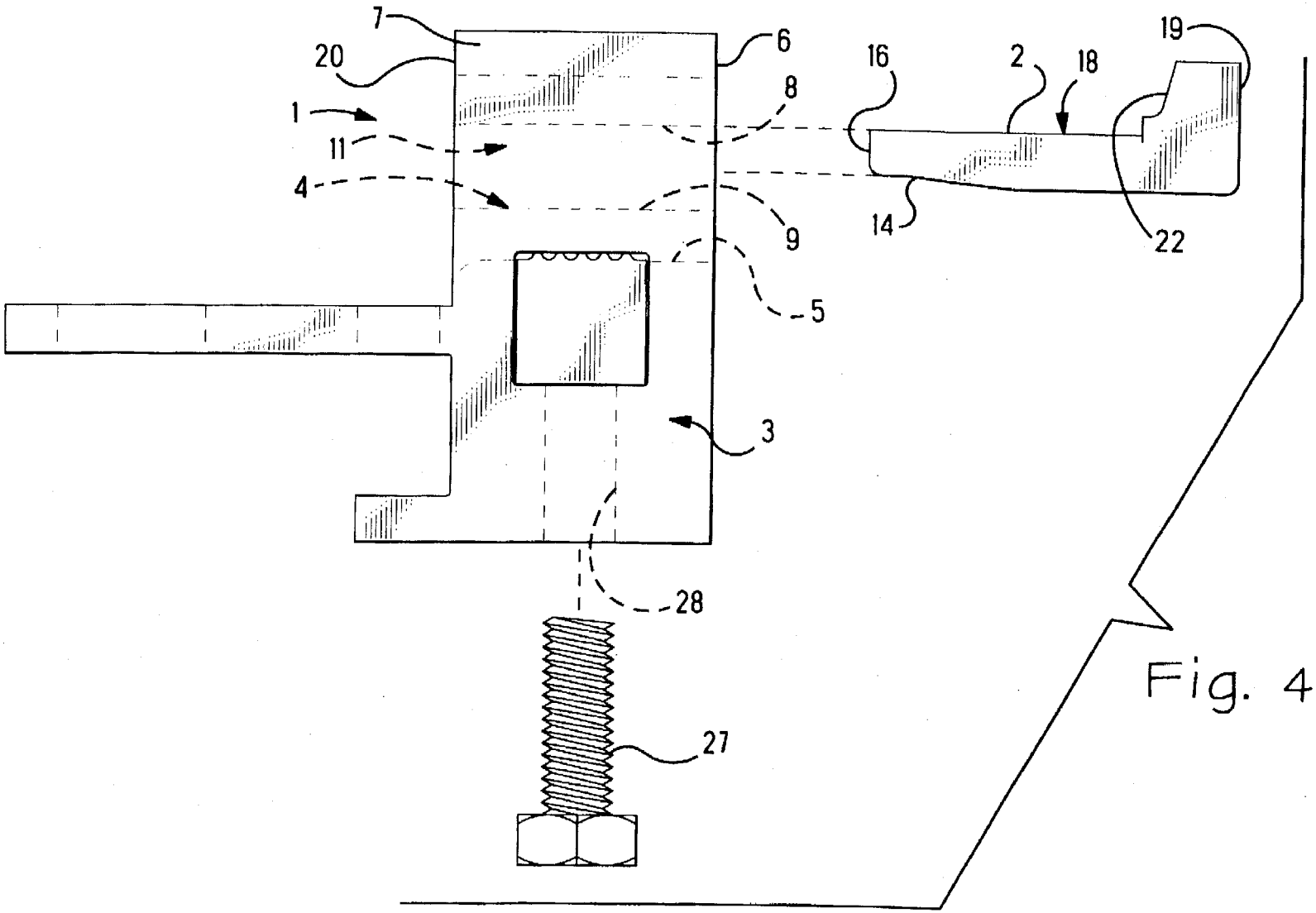
FIG. 4 is a side view of the connector shown in FIG. 1 with parts separated from one another.

Each embodiment of the body 3 further comprises, a series of wire indenting, raised ribs 24 on the floor 5. In the embodiment shown in FIGS. 1–4, the ribs 34 are provided on a plug 25 inserted into a cavity 26 in the body 3. A set screw 27, FIG. 4, is driven against the plug 25. The set screw 27 is received threadably in a tapped opening 28 in the body 3 that communicates with the cavity 26. In the embodiments shown in FIGS. 5–10, and in FIGS. 15–24, the ribs 24 are unitary with the floor 5, and are formed during a stamping operation by embossment of the body 3.

In the embodiment shown in FIGS. 5–10, projections 29 on the body 3 project into the wedge receiving opening 4. The projections 29 overlap respective stop surfaces 30 on a portion of the wedge 2 that is within the opening 4 to resist removal of the wedge 2 from the opening 4.

In the embodiment shown in FIGS. 15–24, the opening 4 extends through two portions 31 of the body 3. The body 3 is a continuous strip of metal that is reversely bent back on itself to extend the two portions 31 across an axis of the opening 4. The free ends 7 of the arms 6 at least partially encircle the opening 4. Further, the free ends 7 are joined together to fully enclose the opening 4.

What is claimed is:

1. An electrical connector for electrical connection to an electrical wire, comprising:

a conductive wedge-receiving body having a wedge-receiving opening, a first side of said wedge-receiving opening defining a wire-engaging floor, a second side of said wedge-receiving opening having a wedge-engaging surface facing the wire-engaging floor such that a wire-receiving space is defined between said wedge-engaging surface and said wire-engaging floor, and a conductive wedge being movable into said wedge-receiving opening and having a sliding surface adjacent said wedge-engaging surface and adapted to engage and be slidable therealong and be pressed thereagainst, and further having a wire-engaging surface compressing the electrical wire when positioned along the wire-engaging floor as said wedge is moved into said wedge-receiving opening thereby clamping the electrical wire between the wire-engaging floor of the wire-receiving body and the wire-engaging surface of the conductive wedge, and said sliding surface and at least a portion of said wire-engaging surface are substantially parallel and adjacent portions of said first and second sides of said wedge-receiving opening are also substantially parallel, whereby said wedge is retained in said wedge-receiving opening by being wedged alongside and compressing said wire.

2. An electrical connector as claimed in claim 1, wherein said wire-engaging floor of said wedge-receiving body has raised ribs transverse to said wedge-receiving opening.

3. An electrical connector as claimed in claim 1, wherein said wire-engaging surface of said conductive-wedge has an inclined surface extending rearwardly from a front end and a noninclined surface extending from an inner end of said inclined surface to a rear end of said conductive wedge.

4. An electrical connector as claimed in claim 1, wherein said wedge-receiving body comprises arms extending from said wire-engaging floor with free ends of said arms including said wedge-engaging surface.

5. An electrical connector as claimed in claim 1, wherein said wire-engaging floor is in a form of a plug having raised ribs disposed in a cavity in said wedge-receiving body.

6. An electrical connector as claimed in claim 4, wherein said wire-engaging surface of said conductive-wedge has an inclined surface extending rearwardly from a front end and a noninclined surface extending from an inner end of said inclined surface to a rear end of said conductive wedge.

7. An electrical connector as claimed in claim 4, wherein said arms have a ledge spaced from said wedge-engaging surface along which bottom surfaces of edges of said conductive-wedge slidably move.

8. An electrical connector as claimed in claim 1, wherein said wire-engaging surface of said conductive wedge has two inclined surfaces with different rates of incline extending rearwardly from a front end, and two noninclined surfaces extending from an inner end of said inclined surfaces to a rear end of said conductive wedge, one of the two noninclined surfaces extending inwardly from the wire-engaging surface while the other of the two noninclined surfaces extends outwardly from the wire-engaging surface.

9. An electrical connector as claimed in claim 2, wherein the raised ribs are unitary with the wire-engaging floor.

10. An electrical connector as claimed in claim 1, wherein, said conductive wedge has a wedge portion containing said sliding surface and said wire-engaging surface and a tool-engaging portion.

11. An electrical connector as claimed in claim 10, wherein said tool-engaging portion is the same width as that of said wedge portion.

12. An electrical connector as claimed in claim 10, wherein said wedge portion is wider than said tool-engaging portion so that said tool-engaging portion engages tool-engaging members on said wedge-receiving body.

13. An electrical connector as claimed in claim 1, wherein said wedge-receiving body is a continuous strip of metal that is reversely bent back on itself forming parallel portions each having said wedge-receiving opening but only one wedge-receiving opening having said wire-engaging floor.

14. An electrical connector as claimed in claim 13, wherein said wedge-receiving body has first and second parallel portions with one of the parallel portions extending into a planar connection member.

15. An electrical connector as claimed in claim 13, wherein said wedge-receiving body has first, second and third parallel portions with the first and second parallel portions having the wedge-receiving opening and the third portion being a planar member having a connection member extending substantially normal thereto.

16. A wedge member for disposition in a wedge-receiving opening of a wedge-receiving body, comprising:

a wedge portion including a first surface defining a slidable surface positionable adjacent a wedge-engaging surface of the wedge-receiving opening of the wedge-receiving body and adapted to engage and be slidable therealong and be pressed thereagainst, and a wire-engaging surface opposed from said first surface for compressing an electrical wire onto a wire-engaging floor of the wedge-receiving opening, said wire-engaging surface having an inclined surface extending rearwardly from a front end of said wedge portion and a noninclined surface extending from an inner end of said inclined surface to a rear end of said wedge portion, and said sliding surface and at least a portion of said wire-engaging surface are substantially parallel and adjacent portions of said first and second sides of said wedge-receiving opening are also substantially parallel, whereby said wedge is retained in said wedge-receiving opening by being wedged alongside and compressing said wire.

17. A wedge member as claimed in claim 16, wherein said inclined surface is in the form of two inclined surfaces with different rates of incline, and said noninclined surface is in the form of two noninclined surfaces with one of the two noninclined surfaces extending inwardly from the wire-engaging surface while the other of the two non-inclined surfaces extends outwardly from the wire-engaging surface.

18. A wedge member as claimed in claim 16, wherein the slidable surface, inclined surface and noninclined surface are planar.

19. A wedge member as claimed in claim 16, and further comprising a tool-engaging portion.

20. A wedge member as claimed in claim 19, wherein the tool-engaging portion is the same width as said wedge portion and extends substantially normal thereto.

21. A wedge member as claimed in claim 19, wherein the wedge portion is wider than the tool-engaging portion and said tool-engaging portion extends substantially normal to said wedge portion.

* * * * *